US006200237B1

(12) United States Patent
Barrie

(10) Patent No.: US 6,200,237 B1
(45) Date of Patent: Mar. 13, 2001

(54) SLIDING BODY EXPANDING BROADHEAD

(75) Inventor: Bruce Barrie, Waseca, MN (US)

(73) Assignee: Barrie Archery, LLC, Waseca, MN (US)

( * ) Notice: Subject to any disclaimer, the term of this patent is extended or adjusted under 35 U.S.C. 154(b) by 0 days.

(21) Appl. No.: 09/480,786

(22) Filed: Jan. 9, 2000

(51) Int. Cl.[7] ..... F42B 6/08
(52) U.S. Cl. ..... 473/583
(58) Field of Search ..... 473/582, 583, 473/584

(56) References Cited

U.S. PATENT DOCUMENTS 3,138,383 * 6/1964 McKinzie ..... 473/583
5,322,297 * 6/1994 Smith ..... 473/583
5,820,498 * 10/1998 Maleski ..... 473/584
5,879,252 * 3/1999 Johnson ..... 473/583
6,077,179 * 6/2000 Liechty ..... 473/583 X

* cited by examiner

*Primary Examiner*—John A. Ricci

(57) ABSTRACT

An expanding or expandable broadhead tip for arrows wherein a sliding body is provided to carry the blades of the arrow and allow for rotation of the blades to an expanded position. When in folded or inflight position, the rearmost ends of the blades rest on a radial surface of a stationary or positionable stop having a camming front surface and which are held in such position by a retainer. When the tip strikes an object, the sliding body moves rearwardly causing the ends of the blades to override the hold down force of the retainer and as rearward motion continues, the blades are cammed outwardly by the camming front of the stop.

20 Claims, 2 Drawing Sheets

SLIDING BODY EXPANDING BROADHEAD

RELATED APPLICATIONS

Applicant has no and is aware of no applications for patent by others that should be considered with regard to the prosecution of this application.

SPONSORSHIP

Applicant has not been either Federally or Independently sponsored in affording this invention, all the invention being all his own effort.

FIELD OF THE INVENTION

This invention relates generally to what is commonly known as an expanding or expandable broadhead tip for arrows and more specifically to such a expanding or expandable broadhead including a blade carrying body slidably mounted on the tip body, having the blades thereof being rotatably carried thereon and held in closed position against the body during storage or flight by their contact with a restraining element which is overcome when the body slides rearwardly upon striking an object with the blades being subsequently cammed outwardly by a camming surface of a fixed positioning device which is positioned adjacent to the arrow shaft front portion.

SHORT SUMMARY OF THE INVENTION

An expandable broadhead arrow tip that includes a primary body positionable on the end of the arrow shaft with the primary body providing a penetration tip, a secondary body slidably positioned thereon and a combined stop and blade camming element. The secondary body carries a plurality of rotatably mounted blades which are normally restrained against rotation by a restraining element carried on an upper surface of the fixed, primary body element. As the secondary body is moved rearwardly on the primary body, the blades override the restraining element and are forced radially outwardly by the frontal camming surface of the fixed, primary element.

During normal flight, the blades are secured in folded position upon the carrying, sliding body by a restraining element. When the penetrating tip strikes a target, the target forces the sliding body rearwardly to cause the rotatable blades to be shifted outwardly as they abut with a fixed cam element and into a position in which they will provide an enlarged entrance into the target.

BACKGROUND AND OBJECTS OF THE INVENTION

Expandable broadhead arrow tips are not new to the art. Many of these tips, however include a complex mechanical mounting for the rotatable blades of the tip. Applicant provides an expandable broadhead arrow tip that meets the standards of many states which require such tips to be of specified radial dimensions in both their folded and expanded conditions while providing an effective cutting or penetration opening for the swift dispatch of an animal.

Unlike other expandable broadheads that fold back into cutting position, applicant's design provides that the blades lie rearwardly and are cammed into cutting position. Such a design is stronger and more stable than previous broadheads and also eliminates arrow deflection on angled hits upon the target which is deflection is characteristic of complete fold-back tips.

Applicant provides, at least in one form, a carrying body which includes a penetrating tip, and area of reduced diameter axially therebehind, a sliding body on such on such area of decreased diameter and a stationary stopping and camming member. The stopping and camming member includes a frontal camming surface which contacts the blades of the tip to move them outwardly into full cutting diameter. The blades, when in folded position rest upon an upper surface of such stop and are held in such position by a restraining member.

All of the elements of the Applicant's tip provide simply replaceable portions such that in the field replacement and repair may be easily accomplished. The Applicant's concept also provides for alignment of the cutting surfaces of the penetrating tip and the blades thereof.

Applicant's design also allows for ease of blade replacement by simply replacing the blade carrying body. The blade retaining element provided by applicant is reusable and by simply removing this element, the tip may be shot in an open position and meet the legal cutting diameters as set by various states.

With Applicant's device, the blade carrying member may be slid rearwardly and the tip fired as a fixed broadhead in jurisdictions where expandable broadheads are prohibited.

Applicant submits that, even in a well developed area of expertise, that his expandable broadhead arrow tip provides a unique and patentably distinct design from such art as will be better understood from a consideration of the accompanying drawings and disclosure.

SHORT DESCRIPTION OF THE DRAWINGS

DESCRIPTION OF A PREFERRED EMBODIMENT OF THE INVENTION

Figure 1:
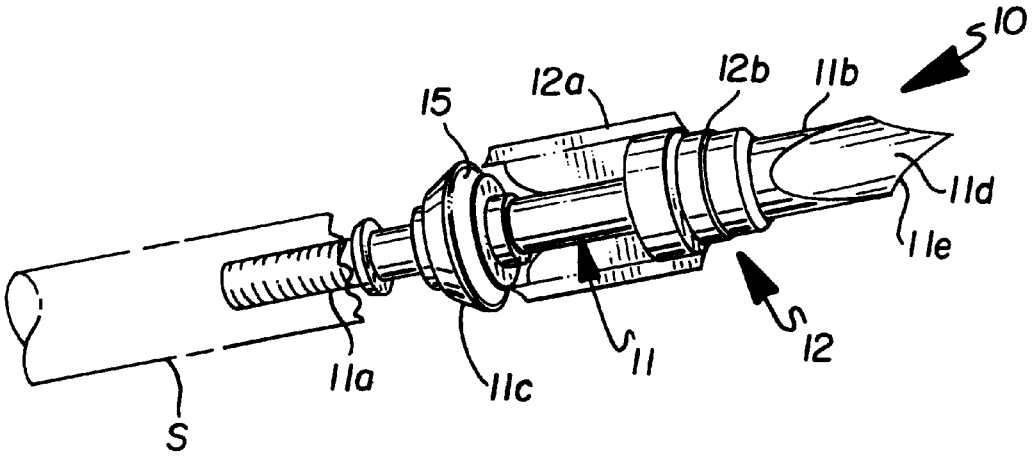
FIG. 1 is a perspective, longitudinal view of an expandable, broadhead arrow tip embodying the concepts of the Applicant's invention and illustrating the same attached to the forward end of the shaft of an arrow with the blades thereof in folded or retracted position for flight or storage.
Figure 2:
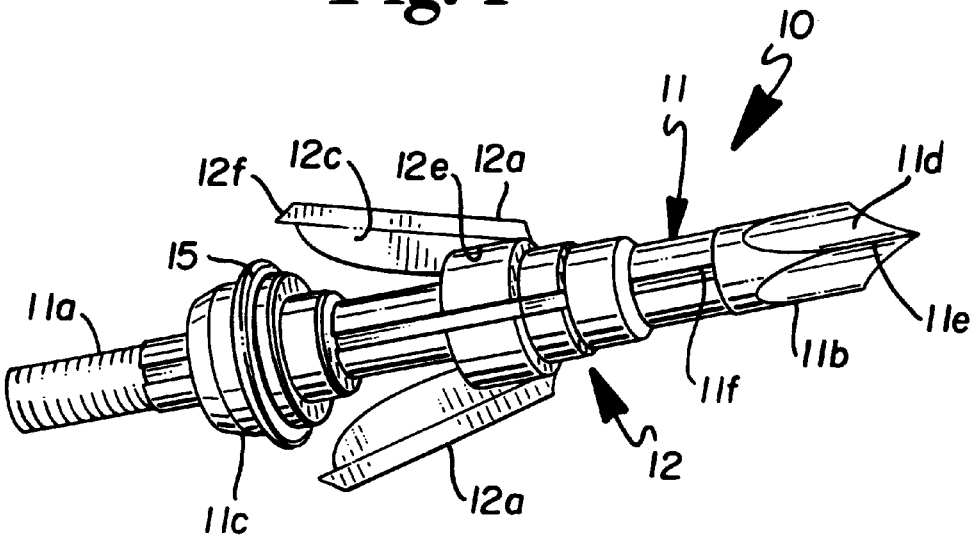
FIG. 2 is a view similar to FIG. 1 illustrating the blades of the tip in partially open position.
Figure 3:
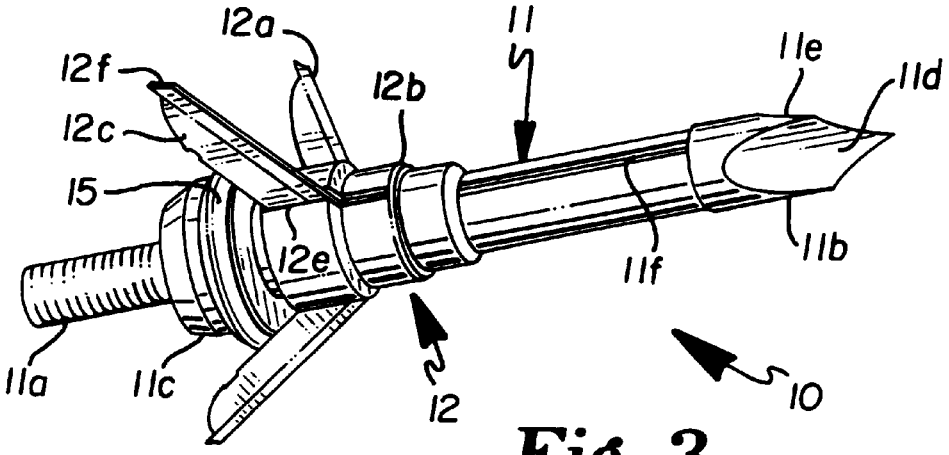
FIG. 3 is a view similar to FIGS. 1 and 2 illustrating the blades of the tip in fully opened position.

In accordance with the accompanying drawings, Applicant's expandable broadhead arrow tip is generally designated 10 and is illustrated mounted on the forwardmost end of an arrow shaft S.

The tip 10 includes a longitudinally extending body portion 11 having a threaded end 11*a* for mounting to shaft S, a penetrating end 11*b* and a stop 11*c* may be slidable along said body 11 to normally rest against the frontal surface of shaft S or may be positively located along said body 11, a predetermined distance from penetrating end 11*b*. Body 11 may be of reduced diameter with respect to either the tip 11*b* or stop 11*c*. As illustrated, the penetrating tip 11*b* is machined to provide at least a pair of and preferably a plurality of surfaces 11*d* with the meeting of adjacent pairs thereof providing a common edge 11*e*. Body 11 is provided with a set of grooves 11*f*, the number thereof being in agreement with the number of such tip edges 11*e* such that alignment will be afforded between such grooves, 11*f,* tip edges 11*d* and blades 12*a* carried by a sliding body 12 arranged on said body 11 between said penetrating tip 11*b* and said stop 11*c*.

The sliding body 12, includes a frontal end 12*b,* in the form shown stepped on the exterior thereof, which is step formation is a matter of choice, but which illustrates a body of increasing diameter such that as the tip enters a target entry opening, the sliding body 12 will be forced rearwardly, and has an inner diameter to permit sliding upon body 11. A plurality of lands, not shown, matching the number and position of grooves 11*f* of body 11 are provided on the inner diameter of body 12 and in this manner, the blades 12*a* are held in alignment with the aforementioned cutting edges 12*d* of penetrating tip 12*b*. Similarly the innermost sides or edges 12*c* of blades 12 will normally slide within such grooves 11*f* during flight of the arrow or when the arrow is in storage or being transported.

Each of the blades 12*a* is rotatably captured in body 12 through a pin 12*d* and the body must essentially be cut as at 12*e*, which may extend forwardly along such body section, as will be further understood in the following operational statement, to permit the blade 12*a* to freely move between folded and open position. As illustrated, the rearmost end 12*f* of each of the blades 12 is formed to provide an area of abutment to act against a flexible or movable retaining element 15 in FIGS. 1, 2, 3 and 4 and 15*a* in FIG. 5.

Stop element 11*c* may or may not be secured secured to body 11 and when not secured will normally abut with the front of the arrow shaft S but which, primarily, performs four functions. A first function is simply as a stop against further movement of sliding body 12, the second is to provide a locating surface 11*g* If to receive the ends 12*f* of the blades 12*a* and support the same during folded operation, the third is to provide a camming surface 11*h* on the forwardmost end thereof and the fourth being a surface for placement of retaining element 15, 15*a*.

The aspects of the stop 11*c* and the blade rest functions should be obvious and the camming is accomplished by the rearward movement of body 12 and the resulting abutment of the lower surface 12*c* of blades 12 with such camming surface 11*h* which will force the blades 12*a* radially outwardly into the expanded or target penetrating position to enlarge the target entrance opening. Preferrably, frontal surface 11*g* is arranged angularly to the axis of body 11 to smoothly force the blades 12*a* outwardly into such position.

Figure 5:
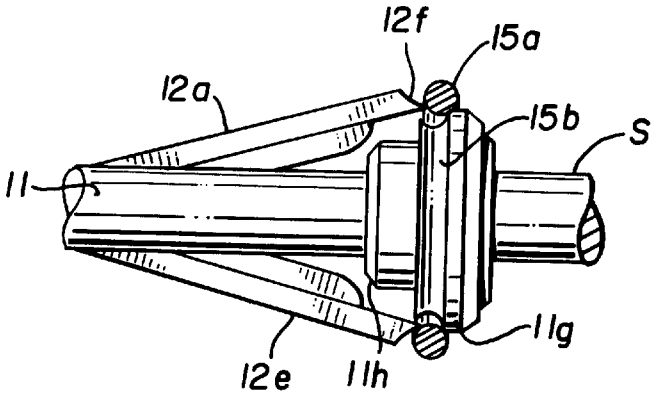
Figure 4:
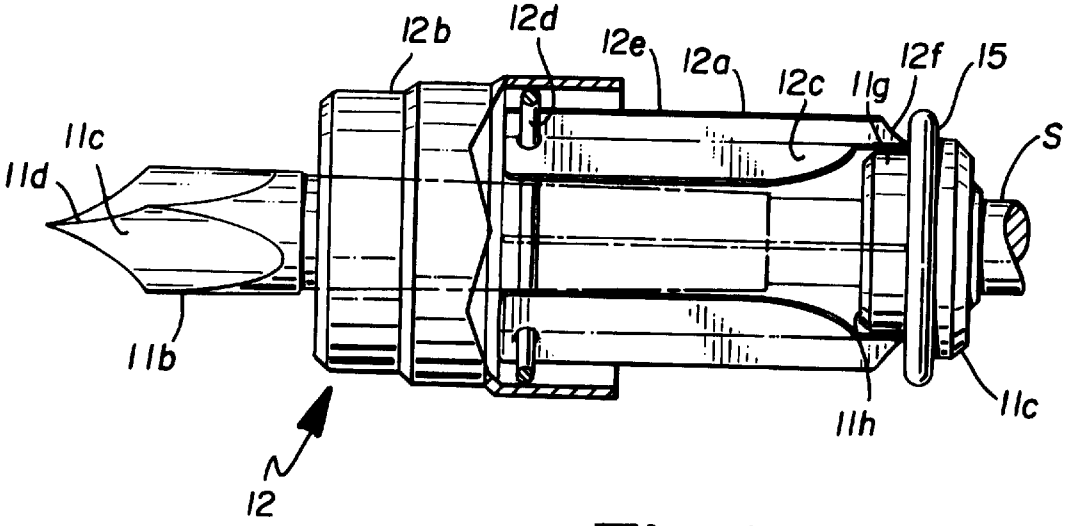
FIG. 4 is a partial, longitudinal section of the tip illustrating the blades in folded position; and, FIG. 5 is a view similar to FIG. 4 illustrating the coaction of the blades as the carrying body therefor is shifted rearwardly to move past the retaining member and ultimately into fully expanded position.

The blade 12*a* holding and retaining structure is illustrated in FIGS. 4 and 5. In FIG. 4 the element 15 may take several forms and is illustrated with a smoothly curved top while in FIG. 5 element 15*a* is illustrated as an O-ring and stop 11*c* is provided with an O-ring receiving groove 15*b*. In either situation, the element 15, 15*a* is closely fitted to the outer diameter of stop 11*c* or lies within groove 15*b*. The action of such element is identical in either embodiment. The rearward movement of body 12 forces the end 12*f* of the blades 12*a* against the element 15, 15*a* to shift the same rearwardly upon shoulder 11*g* and in the case of FIG. 4 such shifting simply moves such element to allow rotation of blades 12*a* while in the case of FIG. 5 the rearward movement of body 12 actually partially dislodges the O-ring 15*a* from groove 15*b* to again allow the blades 12*a* to move therepast. In either instance, the elements 15, 15*a* may or may not be destroyed and it should be obvious that with the form of 15, if the element is not destroyed it is simply slid forward to engage the ends 12*f* of refolded blades 12*a* while with the O-ring 15*a*, simple rearward hand displacement of the same is required to permit reestablishment of blade 12*a* location to folded position is required. In either form then, such element 15, 15*a* is simply defined as a retaining element to hold the blades 12*a* in folded position.

The operation and use of such blade should be obvious from the above description. The tip 10 is secured on the arrow shaft S with the tip including the primary body 11 and the sliding body 12. The blades 12*a* of body 12 are folded into position against surface 11*f* and retaining element 15 or 15*a* is brought into holding abutment with the ends 12*f* thereof. Upon shooting the arrow, when it hits the target, the force and initial penetrated opening will bring the sides of the opening into contact with the sliding body 12 and force the same rearwardly. Upon such rearward movement, the ends 12*f* of the blades 12*a* will force the retaining element 15 rearwardly to allow the blades 12*a* to clear the same and continue their outward movement by obtaining contact with the camming surface 11*h* of stop 11*c*. Similarly if the form 15*a* of retaining element is being utilized, the rearward movement of the blades 12*a* will slightly dislodge the same from the groove and permit the blades 12*a* to again move outwardly as the V ride upon camming surface 11*h*. Removal of the arrow and tip from the target is enhanced by the length of body opening 15*e* which will permit the rearward retraction of the arrow, causing the blades to revolve more fully about their mounting pins 12*d*.

It should be obvious that Applicant has provided a new and unique expanding broadhead arrow tip.

What is claimed is:

1. An expandable broadhead arrow tip for attachment to the forward end of an arrow shaft, including:

a) a primary body having one end thereof adapted to be secured to the end of an arrow shaft and having a penetrating tip on the other end thereof;

b) said primary body providing a sliding surface along a length thereof;

c) a stop provided on said primary body, said stop being positionable along said primary body;

d) said stop having a blade camming surface on a select portion thereof;

e) a slidable body member on said primary member, said slidable body having at least a pair of blades mounted thereon, said slidable body arranged for sliding movement from said tip to said stop;

f) said blades each having one end thereof rotatably mounted to said slidable body member, said blades being cammed outwardly against said stop when said body is moved toward said stop; and, g) blade restraining means to normally hold said blades in a folded position and releasing said blades to a target penetrating position as said slidable body member is moved towards said stop.

2. The expandable broadhead arrow tip as set forth in claim 1 and said stop extending outwardly from said primary body.

3. The expandable arrow tip as set forth in claim 2 and said stop being positionable along said primary body.

4. The expandable broadhead arrow tip as set forth in claim 2 and a blade resting surface being arranged on the exterior of said stop.

5. The expandable broadhead arrow tip as set forth in claim 4 and said blade restraining means being arranged on said blade resting surface contacting said other blade end to hold said blades in folded position when said slidable body is adjacent said tip and releasing said blades to move the same to target penetrating position when said slidable member is moved towards said stop.

6. The expandable broadhead arrow tip as set forth in claim 5 and said restraining member including a flexible ring member.

7. The expandable broadhead arrow tip as set forth in claim 6 and said blade resting surface including a ring receiving groove therein to receive at least a portion of said ring member.

8. The expandable broadhead arrow tip as set forth in claim 5 and said restraining member being shiftable on said blade resting surface and being moved thereon by rearward movement of said slidable member to permit said blades to move outwardly from folded position on said resting surface of said stop to target penetrating position.

9. The expandable broadhead arrow tip as set forth in claim 1 and said penetrating tip providing a first cross sectional dimension, said sliding surface being of a cross sectional dimension less than said penetrating tip.

10. The expandable broadhead arrow tip as set forth in claim 1 and said penetrating tip being of a first diameter, said sliding surface being of a lesser diameter.

11. The expandable broadhead arrow tip as set forth in claim 1 and said slidable body providing grooves therein for each of said blades to permit rotation of said blades from folded position to target penetrating position.

12. The expandable broadhead arrow tip as set forth in claim 11 and said grooves permitting rotation of said blades to direct the same forwardly to permit removal of said tip from a target.

13. The expandable broadhead arrow tip as set forth in claim 1 and said slidable body member having a stepped exterior surface.

14. The expandable broadhead arrow tip as set forth in claim 1 and said stop being slidably positionable on said primary body.

15. The expandable broadhead arrow tip as set forth in claim 1 and said stop member including a frontal camming surface contacting said blades when said slidable member moves rearwardly thereagainst to shift the same from a folded position to target penetrating position.

16. An expandable broadhead arrow tip for attachment to the forward end of an arrow shaft, including:

a) a primary body having one end thereof adapted to be secured to the end of an arrow shaft and having a penetrating tip on the other end thereof;

b) said primary body providing a sliding surface along a length thereof;

c) a stop provided on said primary body, said stop being positionable along said primary body;

d) said stop having a blade camming surface on a select portion thereof;

e) a slidable body member on said primary member, said slidable body having at least a pair of blades mounted thereon, said slidable body arranged for sliding movement from said tip to said stop;

f) said blades each having one end thereof rotatably mounted to said slidable body member, said blades being cammed outwardly against said stop when said body is moved toward said stop;

g) blade restraining means to normally hold said blades in a folded position and releasing said blades to a target penetrating position as said slidable body member is moved towards said stop;

h) said penetrating tip having a plurality of forwardly directed surfaces wherein adjacent pairs of said surfaces meet in an edge, wherein a plurality of edges are provided.

17. The expandable broadhead arrow tip as set forth in claim 16 and said blades of said sliding member being aligned with said edges of said tip.

18. The expandable broadhead arrow tip as set forth in claim 16 and means associated with said primary body and said slidable body for maintaining alignment of said blades to said edges of said tip as said slidable member is moved rearwardly.

19. The expandable broadhead arrow tip as set forth in claim 18 said blades having an inner surface receivable into said blade alignment means.

20. The expandable broadhead arrow tip as set forth in claim 19 and said blades including outer, sharpened surfaces.

* * * * *